US010288365B2

(12) United States Patent
Shin

(10) Patent No.: US 10,288,365 B2
(45) Date of Patent: May 14, 2019

(54) TURBULENCE GENERATING DEVICE

(71) Applicants: Dae Myeong Eng Co., Ltd., Pyeongtaek-si (KR); Kyung-Jae Shin, Incheon (KR)

(72) Inventor: Kyung-Jae Shin, Incheon (KR)

(73) Assignee: Dae Myeong Eng Co., Ltd., Pyeongtaek-si (KR)

( * ) Notice: Subject to any disclaimer, the term of this patent is extended or adjusted under 35 U.S.C. 154(b) by 0 days.

(21) Appl. No.: 15/555,971

(22) PCT Filed: Feb. 15, 2016

(86) PCT No.: PCT/KR2016/001479
§ 371 (c)(1),
(2) Date: Sep. 5, 2017

(87) PCT Pub. No.: WO2016/144014
PCT Pub. Date: Sep. 15, 2016

(65) Prior Publication Data

US 2018/0051944 A1 Feb. 22, 2018

(30) Foreign Application Priority Data

Mar. 6, 2015 (KR) ..... 10-2015-0031815

(51) Int. Cl.
*F28F 13/12* (2006.01)
*F28F 1/38* (2006.01)
(Continued)

(52) U.S. Cl.
CPC ..... *F28F 13/12* (2013.01); *F15D 1/0015* (2013.01); *F15D 1/02* (2013.01); *F28F 1/38* (2013.01); *F28D 1/0477* (2013.01); *F28D 7/085* (2013.01)

(58) Field of Classification Search
CPC ..... B01F 5/0602; B01F 5/0614; B01F 2005/0625; B01F 2005/0628;
(Continued)

(56) References Cited

U.S. PATENT DOCUMENTS 1,345,791 A 7/1920 Livingstone
1,484,235 A * 2/1924 Raba ..... F02M 1/00 138/40
(Continued)

FOREIGN PATENT DOCUMENTS

JP S56-133600 10/1981
JP 08-247684 9/1996
(Continued)

OTHER PUBLICATIONS

International Search Report dated May 4, 2016, in International Publication No. PCT/KR2016/001479.
(Continued)

*Primary Examiner* — Patrick F Brinson
(74) *Attorney, Agent, or Firm* — H.C. Park & Associates, PLC

(57) ABSTRACT

A turbulence generating device for generating turbulence and vortices in a fluid inside a fluid transfer pipe, which acts as a heat transfer pipe, such that, by increasing the area of contact of the fluid with the pipe and the time of contact, not only sufficient heat exchange and heat radiation are conducted, but alien substances and the like, which accumulate inside the corresponding pipe, can also be removed.

20 Claims, 22 Drawing Sheets

(51) Int. Cl.

| | |
|---|---|
| ***F15D 1/00*** | (2006.01) |
| ***F15D 1/02*** | (2006.01) |
| *F28D 1/047* | (2006.01) |
| *F28D 7/08* | (2006.01) |

(58) Field of Classification Search

CPC ..... B01F 2005/062; B01F 2005/0636; F02M 35/10262; F28F 13/12; F28F 1/38; F15D 1/0015

USPC ..... 138/40, 42; 366/336–338; 48/189.4

See application file for complete search history.

(56) References Cited

U.S. PATENT DOCUMENTS

| | | | | |
|---|---|---|---|---|
| 2,146,246 | A * | 2/1939 | Barnes | F02M 23/12 48/189.3 |
| 2,216,846 | A * | 10/1940 | Lewis | B01F 5/061 138/40 |
| 2,384,681 | A * | 9/1945 | Janes | F02M 1/00 123/590 |
| 5,800,059 | A * | 9/1998 | Cooke | B01F 5/0656 138/40 |
| 6,796,296 | B2 * | 9/2004 | Kim | B01F 5/0618 123/184.21 |
| 6,901,907 | B2 * | 6/2005 | Wijaya | F02M 29/06 123/306 |
| 7,028,663 | B1 * | 4/2006 | Kim | F01N 13/08 123/306 |
| 7,086,498 | B2 * | 8/2006 | Choi | F01N 1/083 181/270 |
| 7,131,514 | B2 * | 11/2006 | Choi | F01N 1/083 181/270 |
| 8,956,040 | B2 * | 2/2015 | Cornaglia | F01N 3/2892 366/337 |
| 9,144,774 | B2 * | 9/2015 | Livshits | B01F 3/04446 |
| 9,403,133 | B2 * | 8/2016 | Baron | B01F 5/0618 |
| 2008/0184700 | A1 | 8/2008 | Harrer | |
| 2008/0267780 | A1 * | 10/2008 | Wirth | B01F 3/022 416/204 A |
| 2011/0011370 | A1 | 1/2011 | Chien | |
| 2011/0283686 | A1 * | 11/2011 | Jebasinski | B01F 3/04049 60/295 |
| 2013/0286769 | A1 | 10/2013 | Baron | |

FOREIGN PATENT DOCUMENTS

| | | |
|---|---|---|
| JP | 11-072104 | 3/1999 |
| KR | 10-1536552 | 7/2015 |
| WO | 2016/143963 | 9/2016 |

OTHER PUBLICATIONS

Written Opinon dated May 4, 2016, in International Publication No. PCT/KR2016/001479.

Extended European Search Report dated Oct. 1, 2018, issued in European Patent Application No. 16761901.4.

* cited by examiner

TURBULENCE GENERATING DEVICE

CROSS-REFERENCE TO RELATED APPLICATIONS

This application is the National Stage Entry of International Application No. PCT/KR2016/001479, filed on Feb. 15, 2016, and claims priority from and the benefit of Korean Patent Application No. 10-2015-0031815, filed on Mar. 6, 2016, both of which are incorporated herein by reference for all purposes as if fully set forth herein.

BACKGROUND

Field

The invention relates generally to turbulence generating devices, and more particularly, to turbulence generating devices for generating turbulence in a fluid inside a fluid transfer pipe, which comprises a heat transfer pipe, such that, by increasing the area of contact of the fluid with the pipe and the time of contact, not only sufficient heat exchange and heat radiation are conducted, but alien substances and the like, which accumulate inside the corresponding pipe can also be removed. A heat transfer pipe is widely used in various areas such as a heat exchanger, an overheated engine prevention system and a heating and air conditioning system for heavy equipment including cars, an air conditioner, a refrigerator, air purification, food manufacturing, petrochemical processing, shipbuilding, offshore plant, and so on.

DISCUSSION OF THE BACKGROUND

A refrigeration system is a system that as refrigerant moves along the four cycles of a compressor, a condenser, an expansion valve, and an evaporator, thus circulating a thermodynamic cycle, discharges heat to the outside by absorbing heat in the room. A condenser and an evaporator applied to this refrigeration system are called a heat exchanger.

In a heat exchanger, heat exchange is conducted between a medium or fluid flowing inside of a pipe (or a tube) and air outside of the pipe.

And in a boiler, a secondary coolant (water, hot water, etc.) is used in all seasons by cooling or heating water through a cycle such as compression, condensation, expansion, and evaporation.

Heat exchangers have been widely used such as in the field of waste heat recovery from industrial sites, prevention of overheating engine of cars and heavy equipment, an air-conditioner, a refrigerator or a heater, power plant, refrigeration, air purification, food manufacturing, chemical processing, oil refining and transportation.

A heat transfer pipe (or a fluid transfer pipe) is installed inside of a heat exchanger for transferring fluid and exchanging heat with the outside. Heat exchange with refrigerant can be conducted by transferring fluid through the heat transfer pipe, or heat absorption and heat radiation of transferred fluid can be conducted through a heat transfer pipe.

Most of heat transfer pipes are made of copper or aluminum, which has good heat transfer characteristics. Heat transfer pipes may be bent having a coil shape or may have a cooling fin on the outer periphery of the pipes to increase heat exchange area.

However, sufficient heat exchange between fluid inside of the pipes and outside or heat absorption and heat radiation of fluid inside of the pipes cannot be achieved with conventional heat transfer pipes when fluid inside of the pipes is transferred rapidly through straight pipes. Heat transfer pipes having coil-shapes or heat transfer pipes have cooling fins for radiating heat on the outer periphery of the pipes have similar problems.

Thus, conventional heat transfer pipes cannot be expected to have high-efficiency heat exchange efficiency due to the limitation of heat exchange in the contact area and time between fluid and the heat transfer pipes, which is closely related to the high, heat exchange efficiency.

Further, alien substances and the like, which accumulate inside the heat transfer pipe impede the flow of fluid and reduce the heat exchange efficiency, thereby shortening the life of the heat exchanger.

The above information disclosed in this Background section is only for enhancement of understanding of the background of the inventive concepts and, therefore, it may contain information that does not constitute prior art.

SUMMARY

Turbulence generating devices according to the principles of the invention may solve the aforementioned problems by generating turbulence and vortices in a fluid inside a fluid transfer pipe, which comprises a heat transfer pipe, such that, by increasing the area of contact of the fluid with the pipe and the time of contact, not only sufficient heat exchange and heat radiation are conducted, but alien substances and the like, which accumulate inside the corresponding pipe can also be removed.

Additional aspects will be set forth in part in the description which follows and, in part, will be apparent from the disclosure, or may be learned by practice of the inventive concepts.

According to one aspect of the invention, a turbulence generating device for insertion in a fluid transfer pipe includes a body having an inlet and an outlet and a first length extending in a longitudinal direction between the inlet and the outlet, and an outer periphery generally corresponding to an inner periphery of the fluid transfer pipe, at least one discontinuity in the body having a second length extending in a direction from the outlet toward the inlet, the second length being shorter than the first length, at least one impeller extending inwardly inside of the body at a predetermined angle, and an annual bead protruding from an inner periphery of the body inwardly toward the center of the body adjacent to the inlet.

According to another aspect of the invention, a turbulence generating device for insertion in a fluid transfer pipe includes a body having an inlet and an outlet and a first length extending in a longitudinal direction between the inlet and the outlet, and an outer periphery generally corresponding to an inner periphery of the fluid transfer pipe, at least one discontinuity in the body having a second length extending in a direction from the outlet toward the inlet, the second length being shorter than the first length, at least one impeller extending inwardly inside of the body at a predetermined angle, an annual bead protruding from an inner periphery of the body inwardly toward the center of the body adjacent to the inlet, and a flange protruding outwardly from an outer periphery of the body at an end portion of the inlet.

According to another aspect of the invention, a turbulence generating device for insertion in a fluid transfer pipe includes a body having an inlet and an outlet and a first length extending in a longitudinal direction between the inlet and the outlet, and an outer periphery generally corresponding to an inner periphery of the fluid transfer pipe, at least one discontinuity in the body having a second length extending in a direction from the outlet toward the inlet, the second length being shorter than the first length, at least one impeller extending inwardly inside of the body at a predetermined angle, and a flange protruding outwardly from an outer periphery of the body at an end portion of the inlet.

The at least one discontinuity may include an opening in the body.

The opening may be wider near the outlet than the inlet.

The width of the opening may have a minimum value adjacent to the inlet and may increase in width in a direction longitudinally along the body to a maximum value adjacent to the outlet.

The maximum value of the opening may occur at the outlet.

The at least one discontinuity may include a cutting line separating the body into at least two sections.

Each impeller may include a member formed by twisting one corner of one of the cut body sections.

The annular bead may include a plurality of annular beads disposed between the inlet and an end portion of the at least one discontinuity.

The annular bead may include a groove having an annular shape formed in an outer surface of the body, and a protrusion having an annular shape formed in an inner surface of the body, the protrusion corresponding to the groove.

The turbulence generating device may further include a sealing member disposed in the groove.

The body may have one of a generally triangular, square, oval, circular, and rectangular-shaped cross-section.

The turbulence generating device may be provided in combination with a fluid transfer pipe, wherein the turbulence generating device may be retained in the fluid transfer device.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
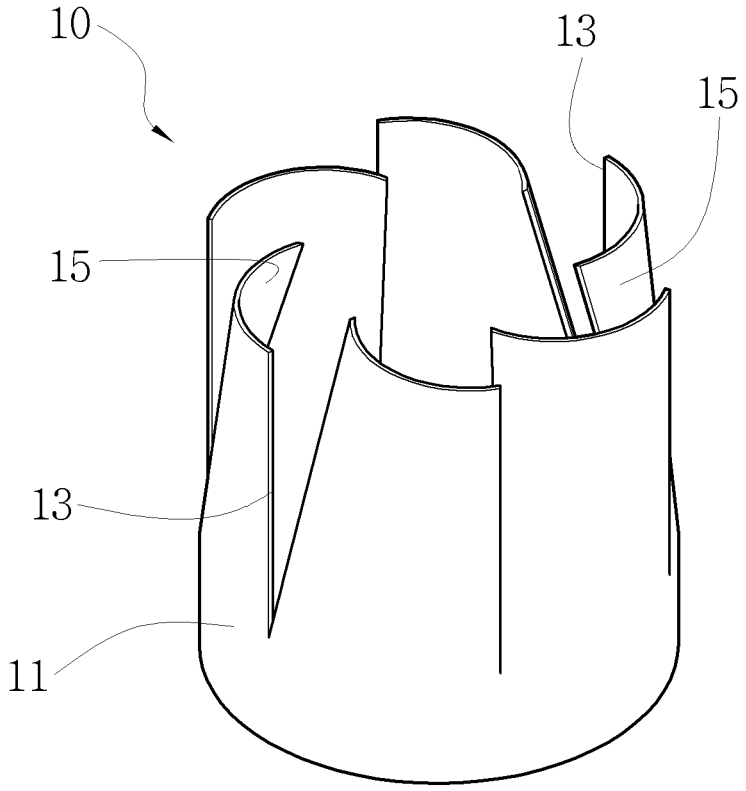
FIG. 1 is a perspective view of a first embodiment of a turbulence generating device according to the principles of the invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. Like reference numerals in the drawings denote like elements.

It will be understood that for purposes of this disclosure, "at least one of X, Y, and Z" can be construed as X only, Y only, Z only, or any combination of two or more items X, Y, and Z (e.g., XYZ, XYY, YZ, ZZ). Unless particularly described to the contrary, the term "comprise", "configure", "have", or the like, which are described herein, will be understood to imply the inclusion of the stated components, and therefore should be construed as including other components, and not the exclusion of any other elements.

Figure 2:
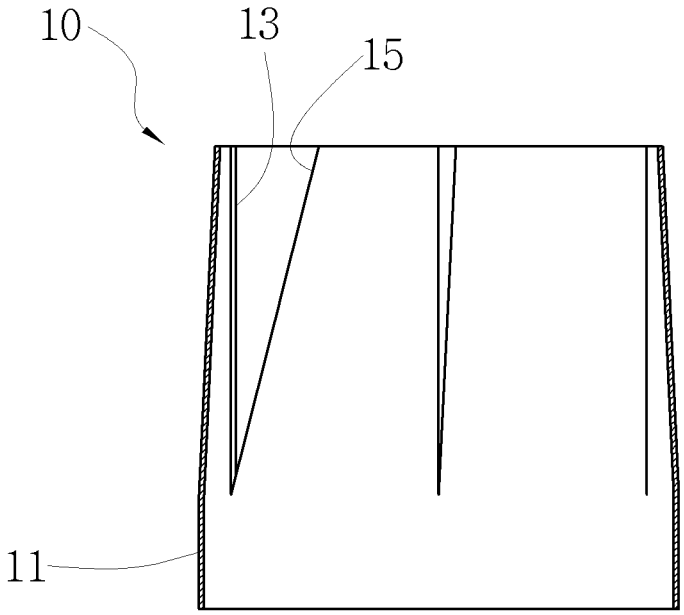
FIG. 2 is a cross-sectional view of the turbulence generating device of FIG. 1.
Figure 3:
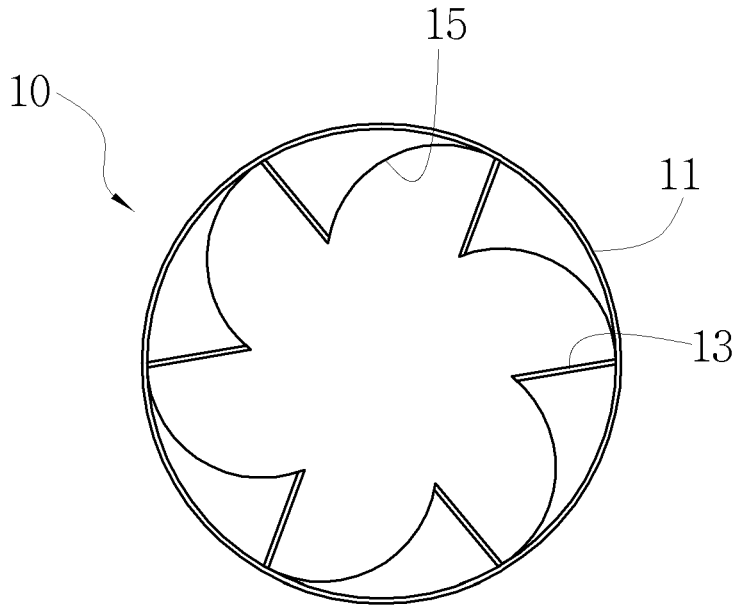
FIG. 3 is a bottom view of the turbulence generating device of FIG. 1.
Figure 4:
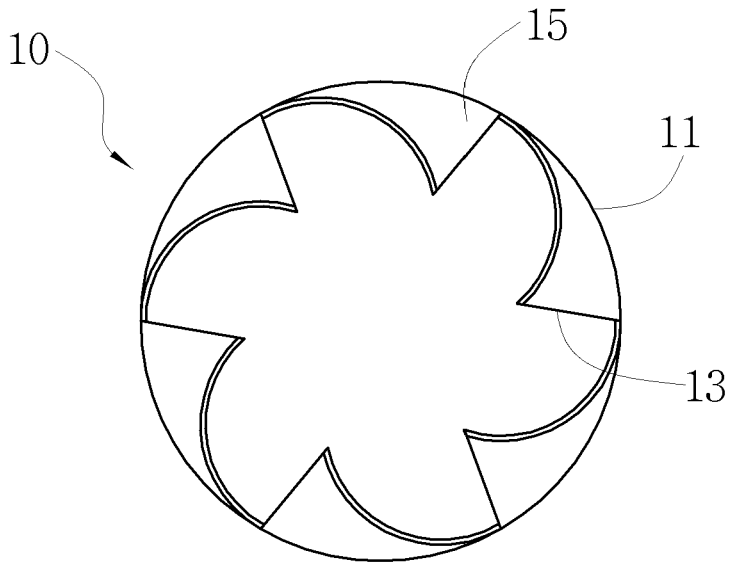
FIG. 4 is a top view of the turbulence generating device of FIG. 1.
Figure 5:
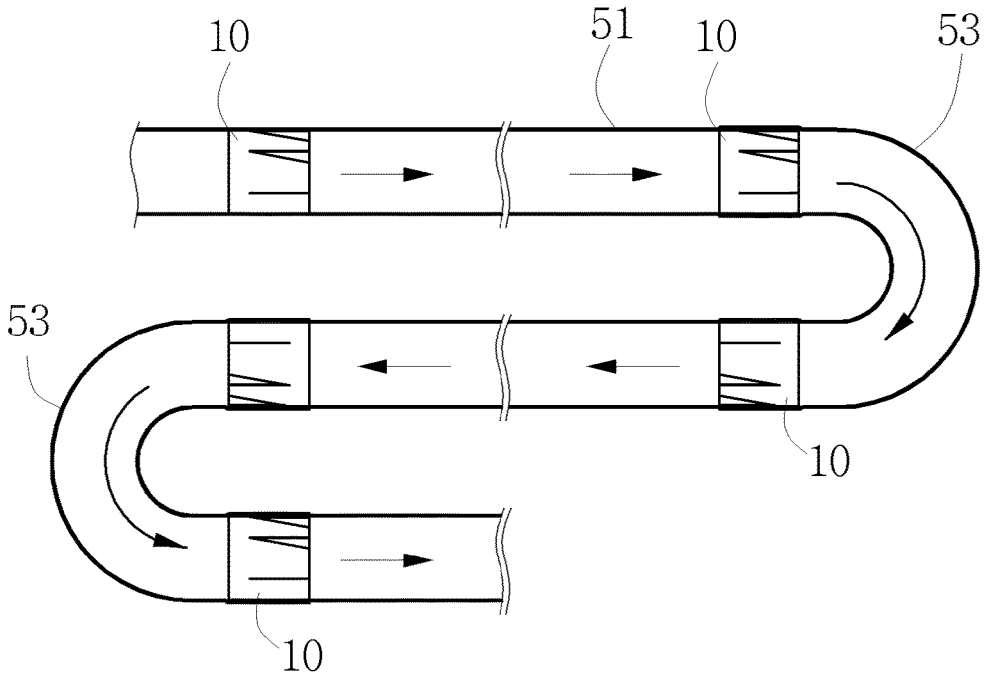
FIG. 5 is a view showing an application example of the turbulence generating device of FIG. 1.

FIG. 1 is a perspective view of a first embodiment of a turbulence generating device according to the principles of the invention. FIG. 2 is a cross-sectional view of the turbulence generating device of FIG. 1. FIG. 3 is a bottom view of the turbulence generating device of FIG. 1. FIG. 4 is a top view of the turbulence generating device of FIG. 1. FIG. 5 is a view showing an application example of the turbulence generating device of FIG. 1.

Referring to FIGS. 1 to 4, turbulence generating device 10 may include body part 11, cutting line 13, and impeller 15 according to the first embodiment of the invention.

In this embodiment, body part 11 is formed in a cylindrical shape so that it may be inserted inside the corresponding cylindrical pipe. That is, body part 11 may be a cylindrical tube of a first length having an outer periphery corresponding to the inner periphery of a cylindrical fluid transfer pipe and having inlet and outlet of fluid at both end portions, which may be inserted into a fluid transfer pipe.

Materials of body part 11 may include petrochemical products, such as metal (including non-ferrous metals), or PVC, but the inventive concepts are not limited thereto. Materials of body part 11 may include various materials.

Cutting line 13 may be formed to cut body part 11 by a second length from the outlet at one end portion of body part 11 toward the inlet at the other end portion of body part 11 in a longitudinal direction. The second length is relatively smaller than the first length.

In the first embodiment, cutting lines 13 are formed as six cutting lines at regular distance as shown in FIGS. 1 to 4, but the inventive concepts are not limited thereto. Cutting lines 13 may be formed as one or more cutting lines at regular distance or at irregular distance.

Impellers 15 may be formed by twisting one corner of cut body part at a predetermined angle in one direction toward inside of body part 11.

In the first embodiment, impellers 15 are formed as six impellers twisted at a predetermined angle in the same direction as shown in FIGS. 1 to 4, but the inventive concepts are not limited thereto. Impellers 15 may be formed as one or more impellers, and at least one of the one or more impellers may be twisted at a different angle or in a different direction than the other impellers.

In the first embodiment, twisted degree of impellers 15 may be about 30 degrees to about 90 degrees, and preferably about 45 degrees, but the inventive concepts are not limited thereto.

A size and shape (such as diameter, length) of body part 11, number and length of cutting lines 13, and number and degree of twisting of impellers 15 of turbulence generating device 10 may be determined selectively according to a size and use of a fluid transfer pipe including a heat transfer pipe which turbulence generating device 10 will be inserted.

As shown in FIG. 5, one or more turbulence generating devices 10 may be inserted and installed in the middle of heat transfer pipe 51 and make turbulence (or vortices) in fluid flowing in heat transfer pipe, and turbulence generating devices 10 may be inserted and installed into the inlet side of U-shaped bent pipe 53 and make turbulence (or vortices) in fluid flowing into U-shaped bent pipe 53.

Figure 6:
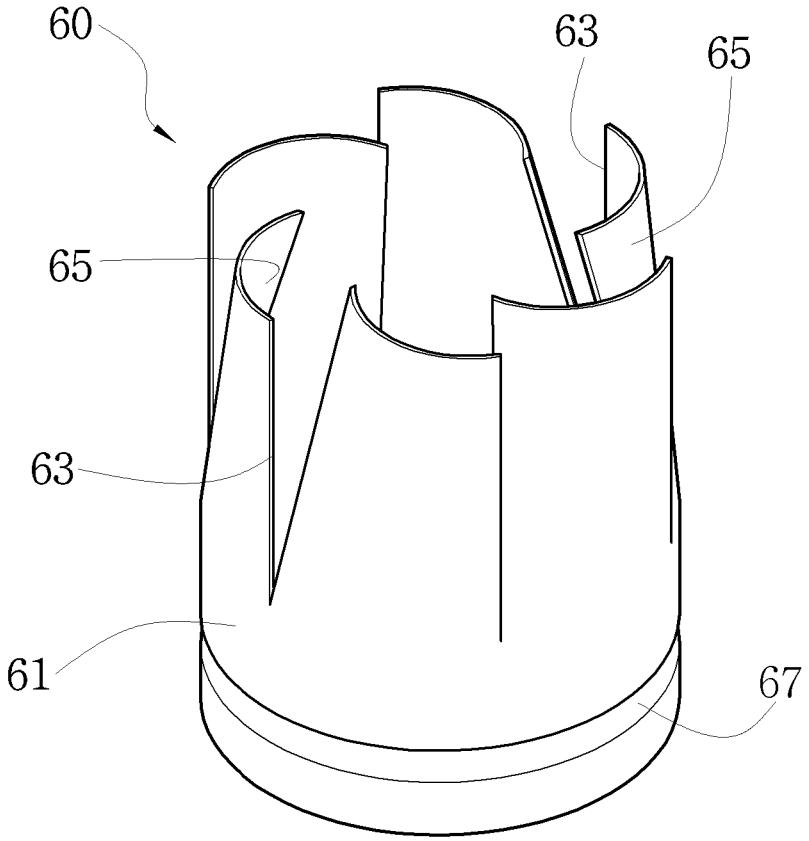
FIG. 6 is a perspective view of a second embodiment of a turbulence generating device according to the principles of the invention.
Figure 7:
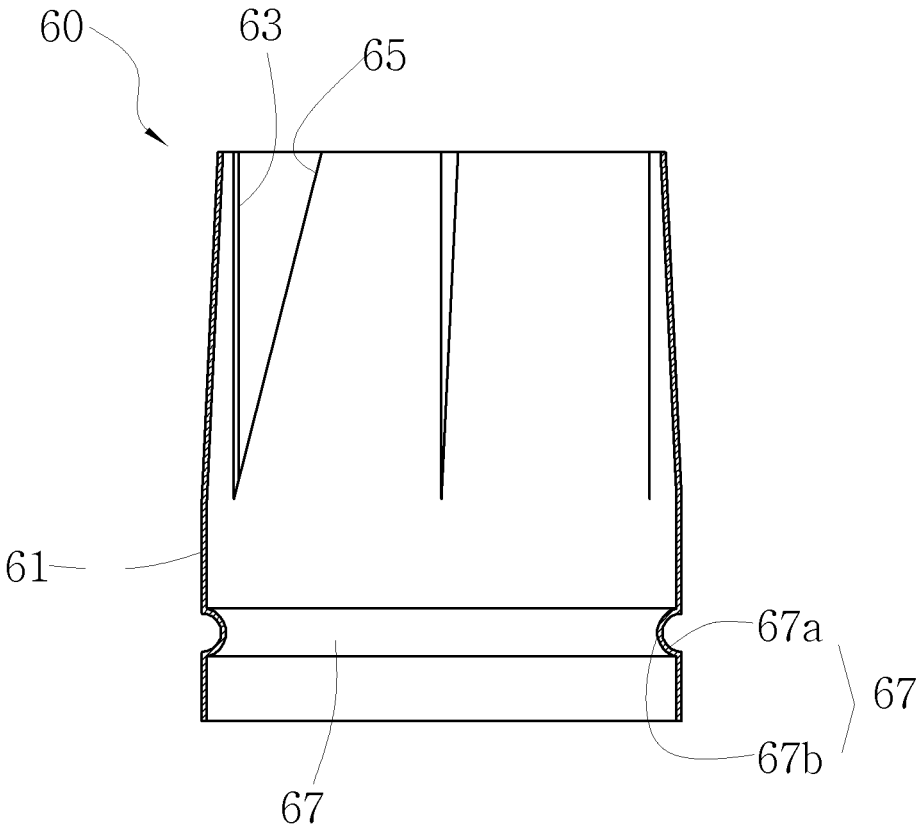
FIG. 7 is a cross-sectional view of the turbulence generating device of FIG. 6.
Figure 8:
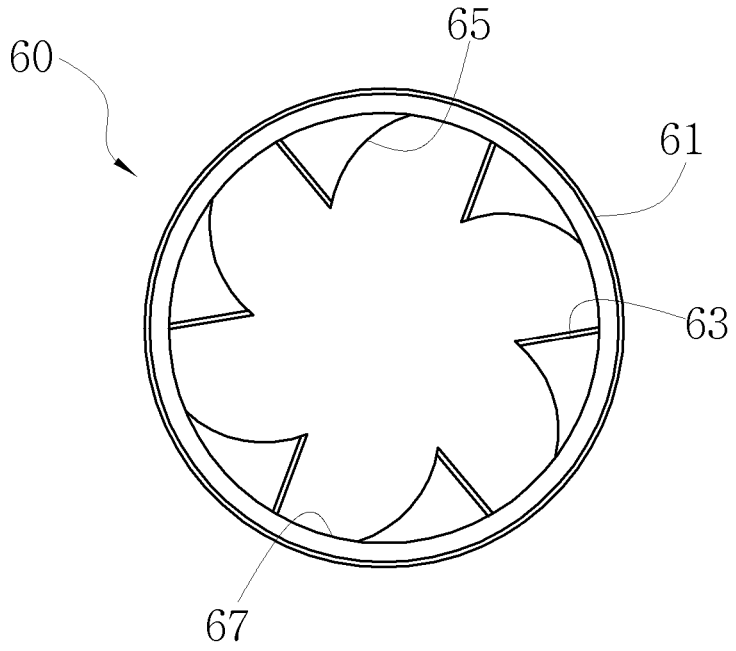
FIG. 8 is a bottom view of the turbulence generating device of FIG. 6.
Figure 9:
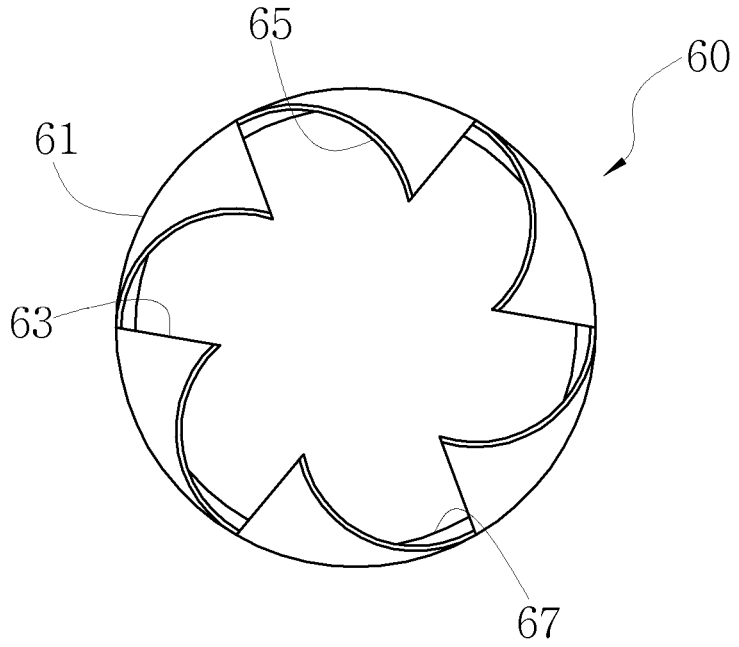
FIG. 9 is a top view of the turbulence generating device of FIG. 6.

In other words, laminar flow flowing in heat transfer pipes 51, 53 advance through cutting lines 13 and impellers 15 formed in the outlet side of turbulence generating device 10 which causes the flow to swirl, and then turbulence and vortices in a fluid inside the corresponding pipes 51, 53 are generated, such that, by increasing the area of contact of the fluid with the pipes 51, 53 and the time of contact, not only sufficient heat exchange and heat radiation are conducted, but alien substances and the like, which accumulate inside the corresponding pipe, can also be removed FIG. 6 is a perspective view of a second embodiment of a turbulence generating device according to the principles of the invention. FIG. 7 is a cross-sectional view of the turbulence generating device of FIG. 6. FIG. 8 is a bottom view of the turbulence generating device of FIG. 6. FIG. 9 is a top view of the turbulence generating device of FIG. 6.

Referring to FIGS. 6 to 9, turbulence generating device 60 may include body part 61, cutting line 63, impeller 65, and bead part 67 according to the second embodiment of the invention.

Body part 61, cutting line 63, and impeller 65 in the second embodiment have the same configurations and functions as, and correspond to, body part 11, cutting line 13, and impeller 15 in the first embodiment, therefore the detailed description will be omitted.

Bead part 67 is a ring-shaped protrusion formed along inner periphery of body part 61 and protruding inward toward the center of body part 61 in the inlet side of body part 61. Bead part 67 may be formed to include one or more bead parts between the inlet of body part 61 and an end portion of cutting line 63.

Bead part 67 may include groove 67*a* having a ring shape and formed in an outer surface of body part 67, and protrusion 67*b* having a ring shape and formed in an inner surface of body part 67. Protrusion 67*b* may correspond to groove 67*a*. Bead part 67 may be formed by press processing of body part 61.

In addition, leakage of fluid may be prevented by sealing a gap that may occur between the inner surface of fluid transfer pipe and the outer surface of body part 61 of turbulence generating device 60 when turbulence generating device 60 including a sealant fitted in groove 67*a* of bead part 67 is inserted in heat transfer pipes 51, 53 as shown in FIG. 5

In the second embodiment, laminar flow in pipes turn into turbulence by bead part 67 as an obstacle, and the corresponding turbulence advance through cutting lines 63 and impellers 65 which causes the flow to swirl. More turbulence and vortices in a fluid inside the corresponding pipes are generated as compared with the first embodiment.

When an inner diameter of the pipe is narrowed down by bead part 67 and widened again and fluid flowing speed is suddenly increased, molecules in the fluid vibrate and thickness of the molecules increases. Turbulence spread to the entire pipe occurs and such turbulence advance through cutting lines 63 and impellers 65 which generate swirling vortex.

Accordingly, due to the generated turbulence, the center and edge of the fluid in the pipe is mixed. Due to the generated vortices, the area of contact of the mixed fluid with the pipe and the time of contact is increased. Sufficient heat exchange and heat radiation are conducted, and alien substances and the like, which accumulate inside the corresponding pipe, can also be removed.

Figure 10:
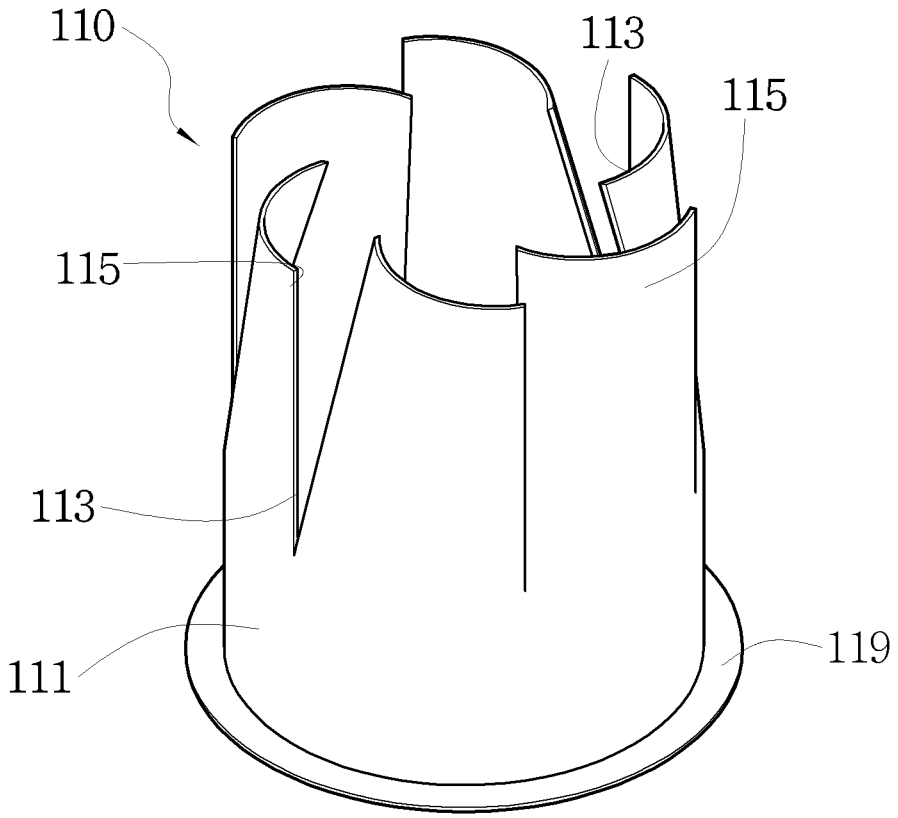
FIG. 10 is a perspective view of a third embodiment of a turbulence generating device according to the principles of the invention.
Figure 11:
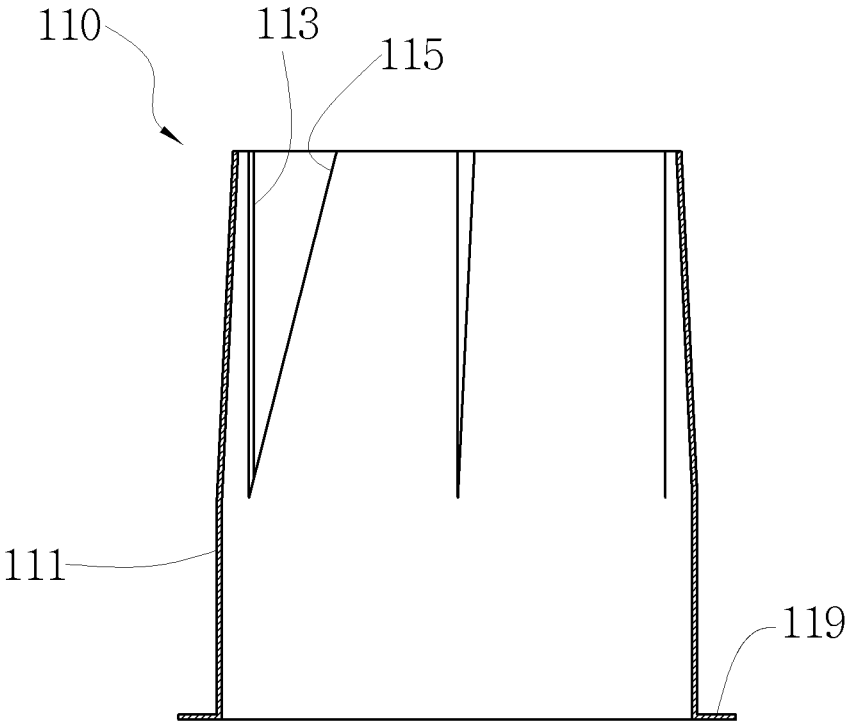
FIG. 11 is a cross-sectional view of the turbulence generating device of FIG. 10.
Figure 12:
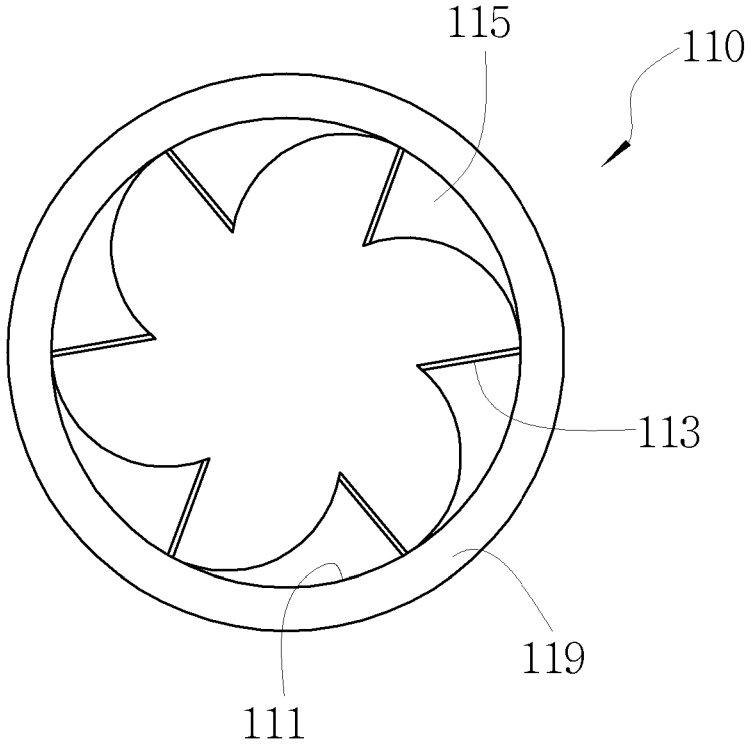
FIG. 12 is a bottom view of the turbulence generating device of FIG. 10.
Figure 13:
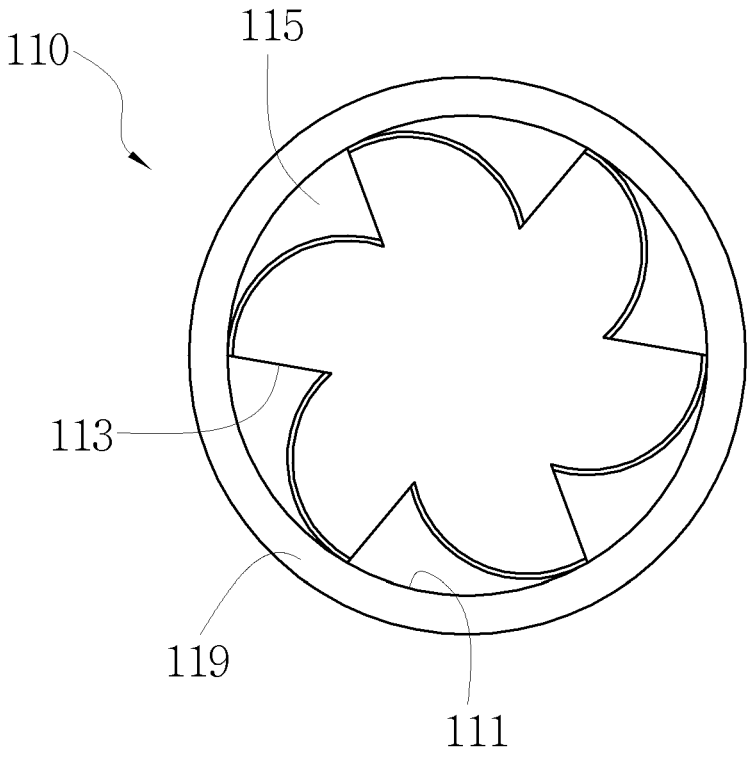
FIG. 13 is a top view of the turbulence generating device of FIG. 10.
Figure 14:
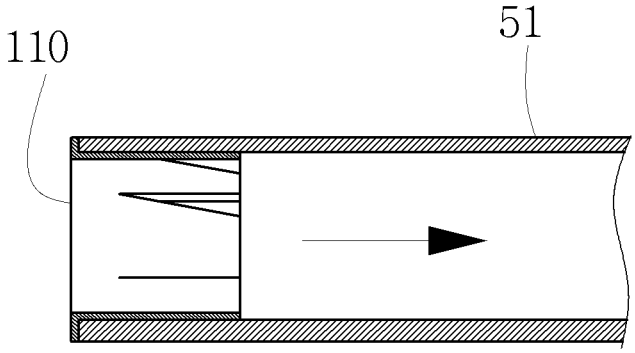
FIG. 14 is a view showing an application example of the turbulence generating device of FIG. 10.

FIG. 10 is a perspective view of a third embodiment of a turbulence generating device according to the principles of the invention. FIG. 11 is a cross-sectional view of the turbulence generating device of FIG. 10. FIG. 12 is a bottom view of the turbulence generating device of FIG. 10. FIG. 13 is a top view of the turbulence generating device of FIG. 10. FIG. 14 is a view showing an application example of the turbulence generating device of FIG. 10.

Referring to FIGS. 10 to 13, turbulence generating device 110 may include body part 111, cutting line 113, impeller 115, and flange part 119 according to the third embodiment of the invention.

Body part 111, cutting line 113, and impeller 115 in the third embodiment have the same configurations and functions as, and correspond to, body part 11, cutting line 13, and impeller 15 in the first embodiment, therefore the detailed description will be omitted.

Flange part 119 may be formed to protrude outward from an outer periphery of body part 111 at an end portion of inlet formed in one side of body part 111.

In the third embodiment, turbulence generating device 110 including flange part 119 may facilitate combining turbulence generating device 110 and heat transfer pipe 51 when turbulence generating device 110 is inserted into inlet side of heat transfer pipe 51 as shown FIG. 14.

Figure 15:
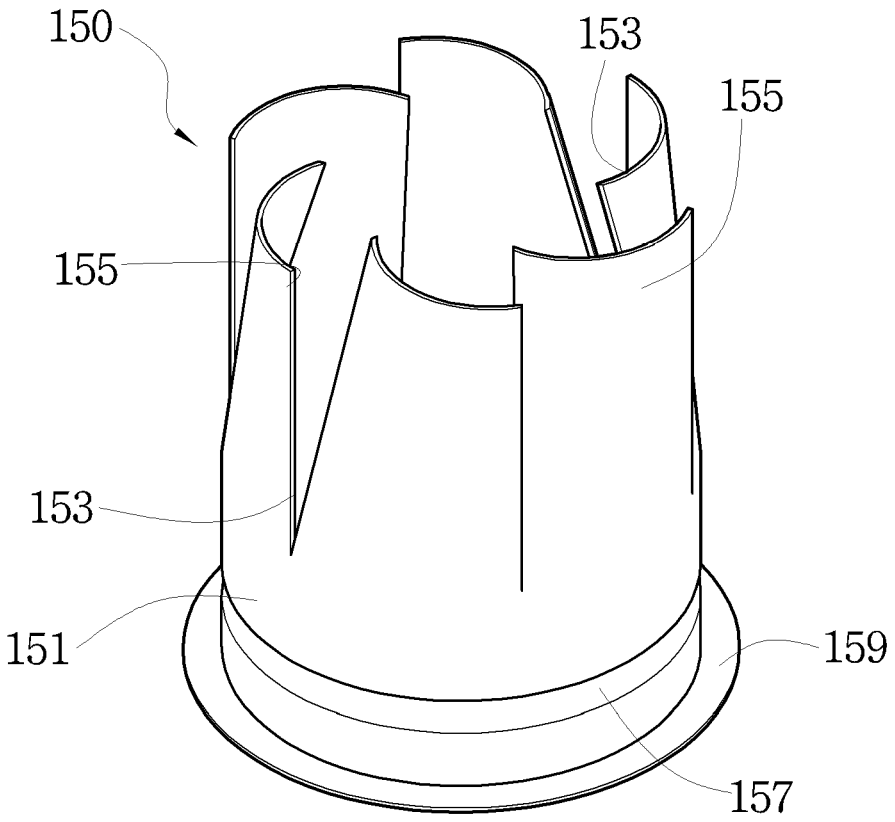
FIG. 15 is a perspective view of a fourth embodiment of a turbulence generating device according to the principles of the invention.
Figure 16:
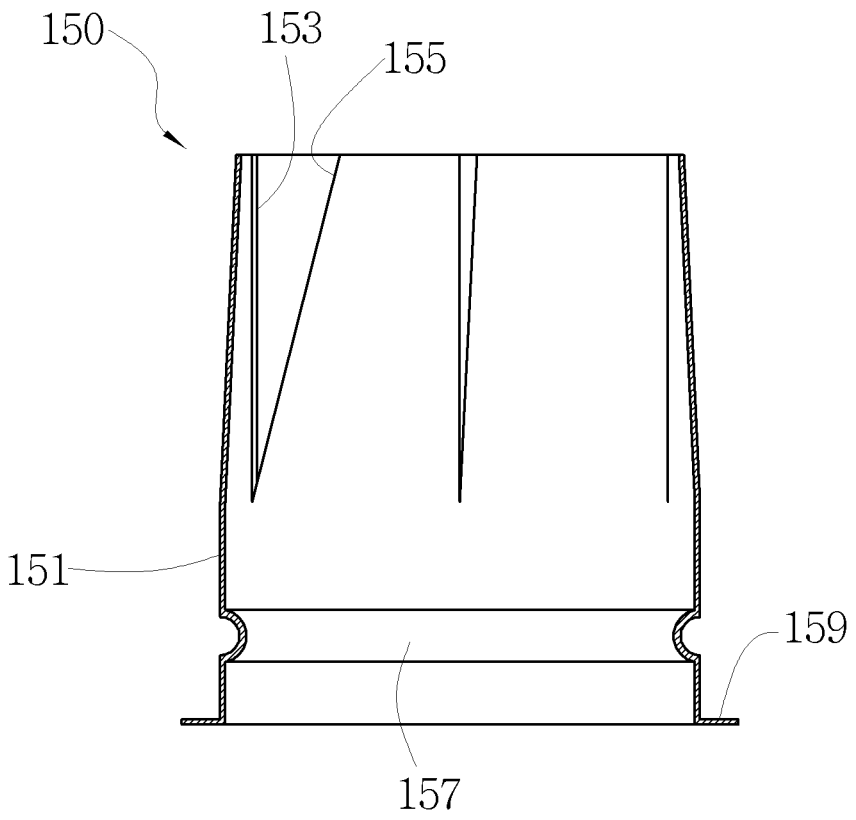
FIG. 16 is a cross-sectional view of the turbulence generating device of FIG. 15.
Figure 17:
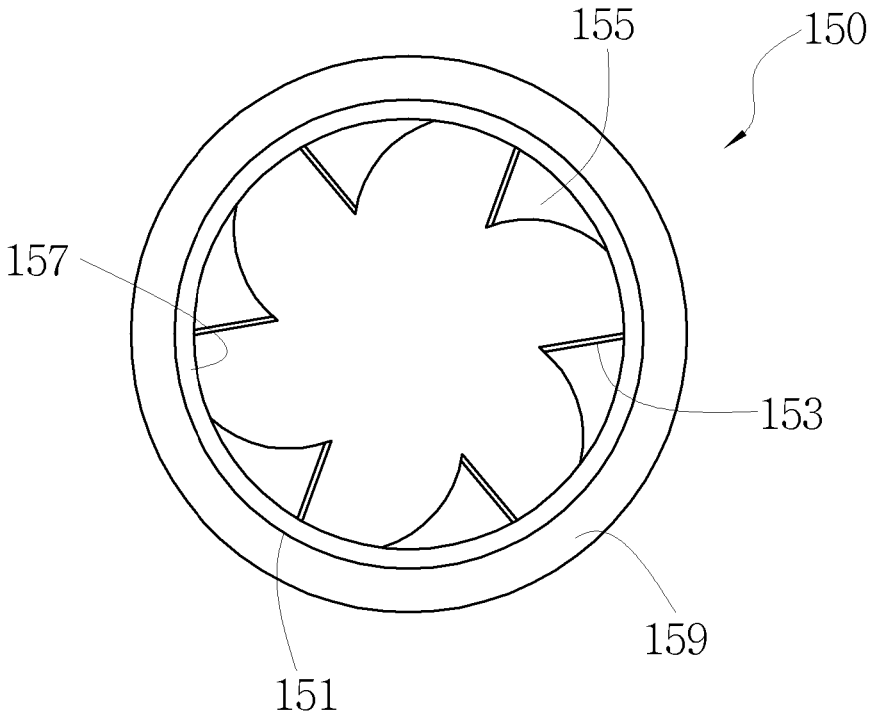
FIG. 17 is a bottom view of the turbulence generating device of FIG. 15.
Figure 18:
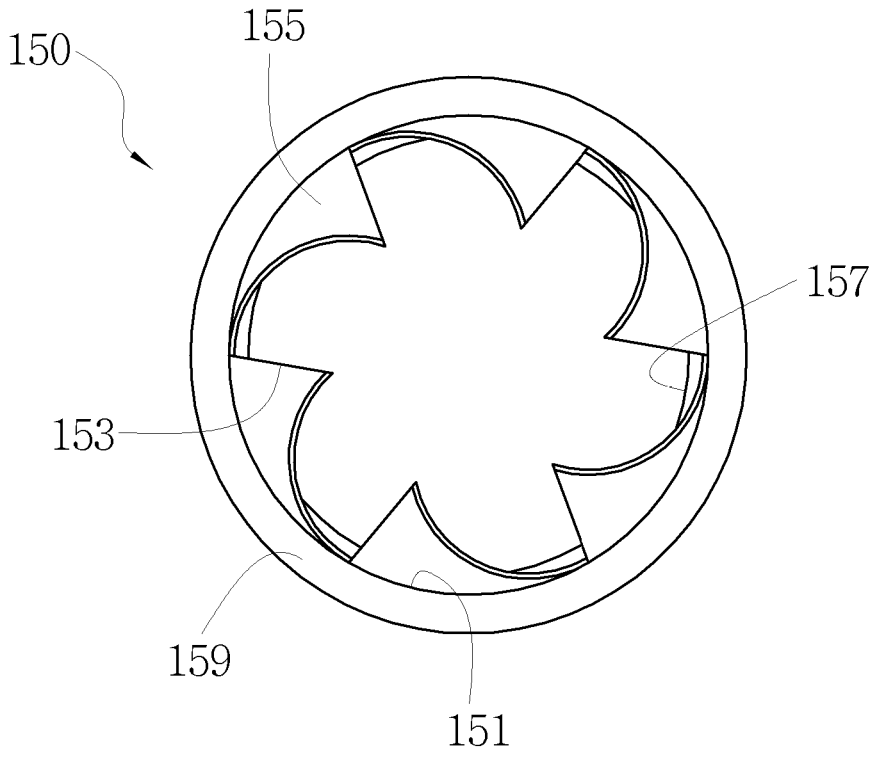
FIG. 18 is a top view of the turbulence generating device of the FIG. 15.

FIG. 15 is a perspective view of a fourth embodiment of a turbulence generating device according to the principles of the invention. FIG. 16 is a cross-sectional view of the turbulence generating device of FIG. 15. FIG. 17 is a bottom view of the turbulence generating device of FIG. 15. FIG. 18 is a top view of the turbulence generating device of the FIG. 15.

Referring to FIGS. 15 to 18, turbulence generating device 150 may include body part 151, cutting line 153, impeller 155, bead part 157, and flange part 159 according to the fourth embodiment of the invention.

Body part 151, cutting line 153, and impeller 155 in the fourth embodiment have the same configurations and functions as, and correspond to, body part 11, cutting line 13, and impeller 15 in the first embodiment. Bead part 157 in the fourth embodiment has the same configurations and functions as, and corresponds to, bead part 67 in the second embodiment. Flange part 159 in the fourth embodiment has the same configurations and functions as, and corresponds to, flange part 119 in the third embodiment. Therefore, the detailed description will be omitted.

FIGS. 19 to 22 are schematic cross-sectional views illustrating various modified embodiments according to the principles of the invention.

Figure 19:
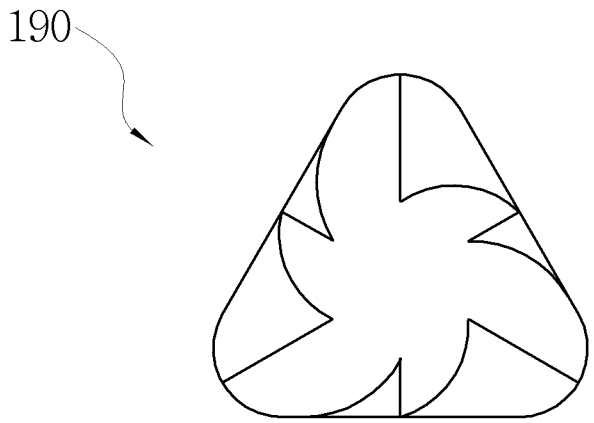
FIGS. 19 to 22 are schematic cross-sectional views illustrating various modified embodiments according to the principles of the invention.

FIG. 19 is a schematic cross-sectional view of a first modified embodiment of turbulence generating device 190 according to the principles of the invention. Turbulence generating device 190 according to the first modified embodiment includes a body part having triangular cross-section instead of a cylindrical tube-shaped body part 11, 61, 111, 151, having circular cross-section in the first to fourth embodiment, and such turbulence generating device 190 may be applied to a triangular tube-shaped heat transfer pipe.

Figure 20:
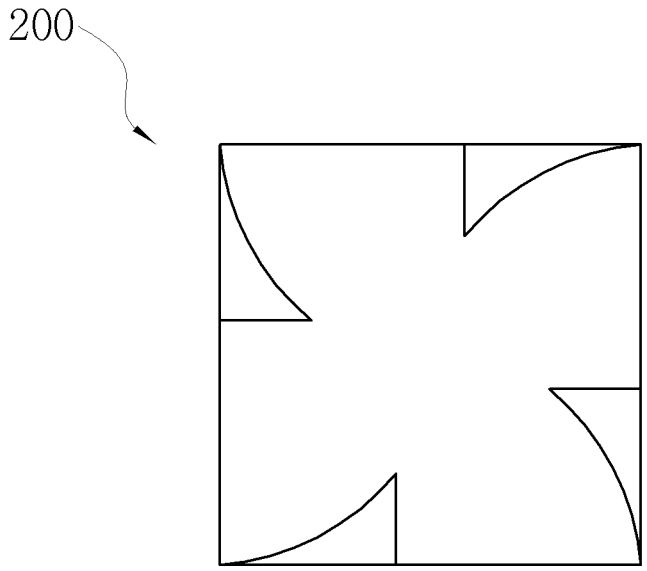

FIG. 20 is a schematic cross-sectional view of a second modified embodiment of turbulence generating device 200 according to the principles of the invention. Turbulence generating device 200 according to the second modified embodiment includes a body part having square cross-section instead of a cylindrical tube-shaped body part 11, 61, 111, 151, having circular cross-section in the first to fourth embodiment, and such turbulence generating device 200 may be applied to a square tube-shaped heat transfer pipe.

Figure 21:
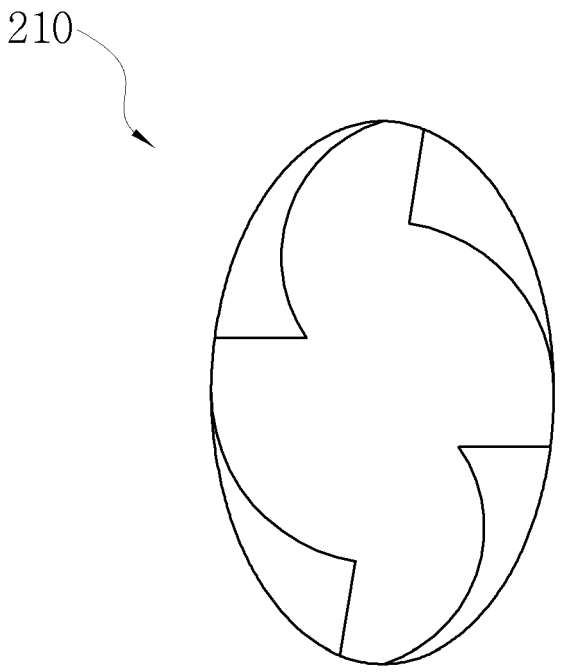

FIG. 21 is a schematic cross-sectional view of a third modified embodiment of turbulence generating device 210 according to the principles of the invention. Turbulence generating device 210 according to the third modified embodiment includes a body part having oval cross-section instead of a cylindrical tube-shaped body part 11, 61, 111, 151, having circular cross-section in the first to fourth embodiment, and such turbulence generating device 210 may be applied to an oval tube-shaped heat transfer pipe.

Figure 22:
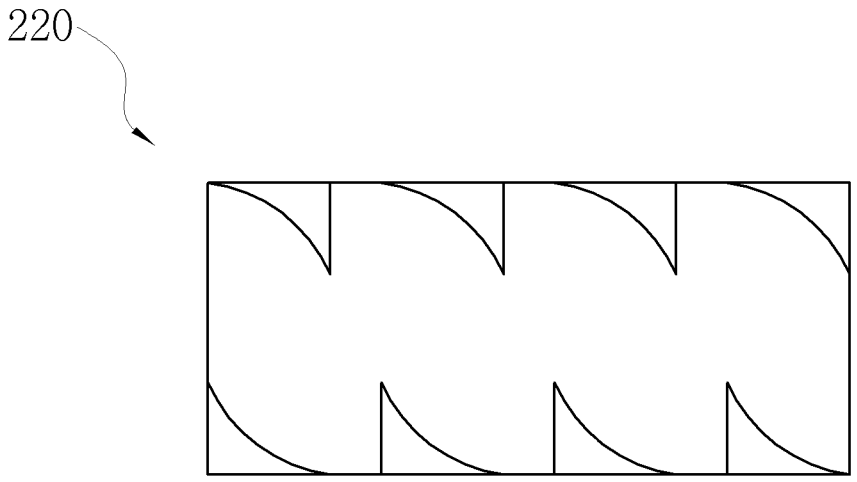

FIG. 22 is a schematic cross-sectional view of a fourth modified embodiment of turbulence generating device 220 according to the principles of the invention. Turbulence generating device 220 according to the fourth modified embodiment includes a body part having rectangular cross-section instead of a cylindrical tube-shaped body part 11, 61, 111, 151, having circular cross-section in the first to fourth embodiment, and such turbulence generating device 220 may be applied to a rectangular tube-shaped heat transfer pipe.

According to various aspects of the invention as described above, by generating turbulence and vortices in a fluid inside a fluid transfer pipe and by increasing the area of contact of the fluid with the pipe and the time of contact, not only sufficient heat exchange and heat radiation are conducted, but alien substances and the like, which accumulate inside the corresponding pipe, can also be removed.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements.

The invention claimed is:

1. A turbulence generating device for insertion in a heat transfer pipe, the turbulence generating device comprising:

a body having an inlet and an outlet and a first length extending in a longitudinal direction between the inlet and the outlet, and an outer periphery generally corresponding to an inner periphery of the heat transfer pipe, wherein the heat transfer pipe has an U-shaped bent section, and the body is inserted into an inlet side of the U-shaped bent section;

at least one discontinuity in the body having a second length extending in a direction from the outlet toward the inlet, the second length being shorter than the first length;

at least one impeller extending inwardly inside of the body at a predetermined angle; and an annular bead protruding from an inner periphery of the body inwardly toward the center of the body adjacent to the inlet.

2. A turbulence generating device for insertion in a heat transfer pipe, the turbulence generating device comprising:

a body having an inlet and an outlet and a first length extending in a longitudinal direction between the inlet and the outlet, and an outer periphery generally corresponding to an inner periphery of the heat transfer pipe;

at least one discontinuity in the body having a second length extending in a direction from the outlet toward the inlet, the second length being shorter than the first length;

at least one impeller extending inwardly inside of the body at a predetermined angle;

an annular bead protruding from an inner periphery of the body inwardly toward the center of the body adjacent to the inlet; and a flange protruding outwardly from an outer periphery of the body at an end portion of the inlet, wherein the heat transfer pipe has an U-shaped bent section, and the body is inserted into an inlet side of the heat transfer pipe such that the flange abuts the heat transfer pipe.

3. A turbulence generating device for insertion in a fluid heat transfer pipe, the turbulence generating device comprising:

a body having an inlet and an outlet and a first length extending in a longitudinal direction between the inlet and the outlet, and an outer periphery generally corresponding to an inner periphery of the heat transfer pipe;

at least one discontinuity in the body having a second length extending in a direction from the outlet toward the inlet, the second length being shorter than the first length;

at least one impeller extending inwardly inside of the body at a predetermined angle; and a flange protruding outwardly from an outer periphery of the body at an end portion of the inlet, wherein the heat transfer pipe has an U-shaped bent section, and the body is inserted into an inlet side of the heat transfer pipe such that the flange abuts the heat transfer pipe.

4. The turbulence generating device of claim 2, wherein the annular bead comprises a plurality of annular beads disposed between the inlet and an end portion of the at least one discontinuity.

5. The turbulence generating device of claim 2, wherein the annular bead comprises:

a groove having an annular shape formed in an outer surface of the body; and a protrusion having an annular shape formed in an inner surface of the body, the protrusion corresponding to the groove.

6. The turbulence generating device of claim 5, the turbulence generating device further comprising a sealing member disposed in the groove.

7. The turbulence generating device of claim 2, wherein the body has one of a generally triangular, square, oval, circular, and rectangular-shaped cross-section.

8. The turbulence generating device of claim 2, wherein the at least one discontinuity comprises an opening in the body.

9. The turbulence generating device of claim 8, wherein the opening is wider near the outlet than the inlet.

10. The turbulence generating device of claim 9, wherein the width of the opening has a minimum value adjacent to the inlet and increases in width in a direction longitudinally along the body to a maximum value adjacent to the outlet.

11. The turbulence generating device of claim 10, wherein the maximum value of the opening occurs at the outlet.

12. The turbulence generating device of claim 11, wherein the at least one discontinuity comprising a cutting line separating the body into at least two sections.

13. The turbulence generating device of claim 12, wherein each impeller comprises a member formed by twisting one corner of one of the cut body sections.

14. The turbulence generating device of claim 2 in combination with the heat transfer pipe, wherein the turbulence generating device is retained in the heat transfer device.

15. The turbulence generating device of claim 1, wherein the at least one discontinuity comprises an opening in the body.

16. The turbulence generating device of claim 15, wherein the opening is wider near the outlet than the inlet.

17. The turbulence generating device of claim 16, wherein the width of the opening has a minimum value adjacent to the inlet and increases in width in a direction longitudinally along the body to a maximum value adjacent to the outlet.

18. The turbulence generating device of claim 17, wherein the maximum value of the opening occurs at the outlet.

19. The turbulence generating device of claim 18, wherein the at least one discontinuity comprising a cutting line separating the body into at least two sections.

20. The turbulence generating device of claim 19, wherein each impeller comprises a member formed by twisting one corner of one of the cut body sections.

* * * * *